US010495079B2

(12) United States Patent
Wells

(10) Patent No.: US 10,495,079 B2
(45) Date of Patent: Dec. 3, 2019

(54) CRYOPUMP HYBRID FRONTAL ARRAY

(71) Applicant: Edwards Vacuum LLC, Sanborn, NY (US)

(72) Inventor: Jeffrey A Wells, Milford, NH (US)

(73) Assignee: Edwards Vacuum LLC, Sanborn, NY (US)

( * ) Notice: Subject to any disclaimer, the term of this patent is extended or adjusted under 35 U.S.C. 154(b) by 262 days.

(21) Appl. No.: 15/270,354

(22) Filed: Sep. 20, 2016

(65) Prior Publication Data

US 2017/0009756 A1 Jan. 12, 2017

Related U.S. Application Data

(63) Continuation of application No. PCT/US2015/021571, filed on Mar. 19, 2015.

(60) Provisional application No. 61/971,973, filed on Mar. 28, 2014, provisional application No. 61/969,029, filed on Mar. 21, 2014.

(51) Int. Cl.
*F04B 37/08* (2006.01)
*F04B 53/16* (2006.01)

(52) U.S. Cl.
CPC ..... *F04B 37/08* (2013.01); *F04B 53/16* (2013.01); *Y10S 417/901* (2013.01)

(58) Field of Classification Search
CPC ..... F04B 37/08; F04B 37/085; B01D 8/00; Y10S 417/901
See application file for complete search history.

(56) References Cited

U.S. PATENT DOCUMENTS 4,094,492 A 6/1978 Beeman et al.
4,546,613 A 10/1985 Eacobacci et al.
4,611,467 A * 9/1986 Peterson ..... F04B 37/08 417/901
5,537,833 A * 7/1996 Matte ..... B01D 8/00 417/901

(Continued)

FOREIGN PATENT DOCUMENTS

EP 1797323 B1 1/2016
GB 2061391 A 5/1981

(Continued)

OTHER PUBLICATIONS

International Preliminary Report on Patentability for PCT/US2015/021571, "Cryopump Hybrid Frontal Array" dated Sep. 21, 2016.

(Continued)

*Primary Examiner* — Keith M Raymond
(74) *Attorney, Agent, or Firm* — Hamilton, Brook, Smith & Reynolds, P.C.

(57) ABSTRACT

A cryopump comprises a refrigerator, a condensing array cooled by the refrigerator, a radiation shield surrounding the condensing array and cooled by the refrigerator. The radiation shield has a frontal opening covered by a frontal array that is also cooled by the refrigerator. The frontal array comprises louvers across an otherwise substantially open center region of the frontal opening and an orifice plate across an outer region of the frontal opening. The hybrid frontal array allows for pumping speeds approximating those of a louver frontal array but with flow control comparable to an orifice plate.

13 Claims, 21 Drawing Sheets

(56) References Cited

U.S. PATENT DOCUMENTS

| | | | | |
|---|---|---|---|---|
| 5,542,257 | A * | 8/1996 | Mattern-Klosson .... | F04B 37/08 417/901 |
| 5,782,096 | A | 7/1998 | Bartlett et al. | |
| 6,155,059 | A | 12/2000 | Matte, Sr. et al. | |
| 9,046,091 | B2 * | 6/2015 | Tanaka ..... | F04B 37/06 |
| 2006/0243562 | A1 | 11/2006 | Lanfranchi | |
| 2010/0077771 | A1 | 4/2010 | Tanaka | |
| 2013/0086926 | A1 | 4/2013 | Xu | |
| 2013/0205805 | A1 | 8/2013 | Bartlett et al. | |
| 2013/0312431 | A1 * | 11/2013 | Syssoev ..... | F04B 37/08 62/55.5 |

FOREIGN PATENT DOCUMENTS

| | | | |
|---|---|---|---|
| JP | S60085276 | | 5/1985 |
| JP | 2010-196632 | A | 9/2010 |
| WO | 2006/036257 | A1 | 4/2006 |
| WO | 2012109304 | A2 | 8/2012 |

OTHER PUBLICATIONS

Extended European Search Report dated Nov. 30, 2017 for European Application No. 15764653.0-1616, entitled "Cryopump Hybrid Frontal Array."

* cited by examiner

Increasing Productivity (Array Performance Summary)

| High pump speed type 2&3 gases | Increased Radiant Heat load to 2nd stage | Highest gas capacity (std-1) | Easy Change of Type II pump speed and heat load to 2nd stage |
|---|---|---|---|
| YES | NO | NO | NO |
| NO | YES | NO | YES |
| NO | NO | YES | NO |
| YES | NO | NO | YES |

CRYOPUMP HYBRID FRONTAL ARRAY

RELATED APPLICATIONS

This application is a continuation of International Application No. PCT/US2015/021571, which designated the United States and was filed on Mar. 19, 2015, published in English, which claims the benefit of U.S. Provisional Application No. 61/971,973, filed on Mar. 28, 2014, and U.S. Provisional Application No. 61/969,029, filed on Mar. 21, 2014. The entire teachings of the above applications are incorporated herein by reference.

BACKGROUND OF THE INVENTION

Cryopumps currently available, whether cooled by open or closed cryogenic cycles, generally follow the same design concept. A low temperature second stage cryopanel array, usually operating in the range of 4-25 K, is a primary pumping surface. This surface is surrounded by a high temperature radiation shield usually operated in the temperature range of 40-130 K, which provides radiation shielding to the lower temperature array. The radiation shield generally comprises a housing which is closed except at a frontal cryopanel array positioned between the primary pumping surface and the chamber to be evacuated. This higher temperature, first stage, frontal array serves as a pumping site for high boiling point gases such as water vapor, known as Type I gases.

In operation, high boiling point gases such as water vapor are condensed on the frontal array. Lower boiling point gases pass through the frontal array and into the volume within the radiation shield. Type II gases, such as nitrogen, condense on the second stage array. Type III gases, such as hydrogen, helium and neon, have appreciable vapor pressures at 4K. To capture Type III gases, inner surfaces of the second stage array may be coated with an adsorbent such as activated carbon, zeolite or a molecular sieve. Adsorption is a process whereby gases are physically captured by a material held at cryogenic temperatures and thereby removed from the environment. With the gases thus condensed or adsorbed onto the pumping surfaces, only a vacuum remains in the work chamber.

In cryopump systems cooled by closed cycle coolers, the cooler is typically a two stage refrigerator having a cold finger which extends through the radiation shield. The cold end of the second, coldest stage of the refrigerator is at the tip of the cold finger. The primary pumping surface, or cryopanel, is connected to a heat sink at the coldest end of the second stage of the cold finger. This cryopanel may be a simple metal plate, a cup or an array of metal baffles arranged around and connected to the second stage heat sink as, for example, in U.S. Pat. Nos. 4,555,907 and 4,494,381, which are incorporated herein by reference. This second stage cryopanel may also support low temperature condensing gas adsorbents such as activated carbon or zeolite as previously stated.

The refrigerator cold finger may extend through the base of a cup-like radiation shield and be concentric with the shield. In other systems, the cold finger extends through the side of the radiation shield. Such a configuration at times better fits the space available for placement of the cryopump.

The radiation shield is connected to a heat sink, or heat station, at the coldest end of the first stage of the refrigerator. This shield surrounds the second stage cryopanel in such a way as to protect it from radiant heat. The frontal array which closes the radiation shield is cooled by the first stage heat sink through the shield or, as disclosed in U.S. Pat. No. 4,356,701, which is incorporated herein by reference, through thermal struts.

Early frontal arrays comprised circular louvers mounted on thermal rods coupled to the radiation shield. Certain louvers may be in the form of chevrons to be more opaque to radiation.

Other pump designs, such as the pump described in U.S. Pat. Nos. 4,449,373, 4,611,467 and 5,211,022, which are incorporated herein by reference, replace the louvers of the first stage with a plate having multiple orifices. The orifices restrict the flow of gases to the second stage array compared to the chevrons or louvers. In certain applications like sputtering processes, by restricting flow to the inner second stage pumping area, a percentage of inert gases are allowed to remain in the working space to provide a moderate pressure (typically $10^{-3}$ Torr or greater) of inert gas for optimal processing. However, higher condensing temperature gases, such as water, are promptly removed from the environment by condensation on the frontal orifice plate.

The frontal array protects the second stage array to reduce radiant heat from striking the second stage, to control Type II and III gas flow rates to the second stage array, and to prevent Type I, higher boiling point temperature, gases from condensing on the colder surfaces and any adsorbent layer. The reduction in radiation and flow rates lowers the temperature of the second stage cryopanel surfaces and the condensed gases on these surfaces as well as any adsorbent. The lower temperature results in an increased gas capture capacity and reduces the frequency of regeneration cycles. The louvers provide very good radiation shielding as compared to the orifice plates, which contain orifices that provide direct line of sight of the radiant heat to the second stage cryopanel surfaces. However, orifice plates severely restrict Type II and Type III gases to the second stage cryopanels compared to the louvers, which results in lower pumping speeds for these gases. In some applications, this severe restriction of pumping speed is preferred because a percentage of inert gases are allowed to remain in the working space of the process chamber to provide a moderate pressure of inert gas for optimal sputtering or other processing.

A modified orifice (sputter) plate is disclosed in published U.S. application 2013/0312431, incorporated herein by reference in its entirety. That frontal orifice plate has a plurality of orifices, each orifice having a flap that is bent from and attached to the frontal plate at an edge of the orifice, and each flap is arranged in a path that passes through the frontal plate. The orifices may be rectangle shaped, square shaped, trapezoid shaped, circle shaped, triangle shaped, or any other shape. The flaps are preferably bent at an angle between 10° and 60° relative to the surface of the frontal baffle plate, and most preferably are bent at an angle between 25° and 35°. For greater speed but higher heat load on the second stage array, angles of 35-45° are preferred. The flaps serve as baffles, so the plate has also been termed a baffle plate.

Advantages of a cryopump having the frontal baffle plate include simplicity of manufacturing and improved blocking of radiation from a process chamber to which the cryopump is attached. Another advantage of a cryopump having the frontal baffle plate is improved distribution of the Type II gases and Type III gases at the second stage array of the cryopump.

SUMMARY OF THE INVENTION

Disclosed herein is a hybrid frontal array that provides advantages of both the louver frontal array and orifice plate frontal array. In particular, a frontal array for a cryopump comprises louvers across an otherwise substantially open center region and a plate surrounding the louvers. The plate may have orifices or other flow paths.

A cryopump comprises a refrigerator, a condensing array cooled by the refrigerator, a radiation shield surrounding the condensing array and cooled by the refrigerator, the radiation shield having a frontal opening, and a frontal array across the frontal opening of the radiation shield. The frontal array is cooled by the refrigerator and comprises louvers across an otherwise substantially open center region of the frontal opening and a plate, across an outer region of the frontal opening. One or more louvers may be in the form of a chevron. The plate may have orifices or other flow paths.

A hybrid frontal array allows for pumping speeds approximating those of a louver array but with the flow control of an orifice plate. Like louvered arrays, the hybrid design produces a large ratio of gas particle transmission through the frontal array to gas particle deflection back to the process space for Type II and Type III gases, which can be process contaminants. The hybrid array also keeps radiation energy to the second stage array relatively low.

The orifices may be open as in a conventional sputter plate, and/or the orifice plate may be a baffle plate in which each of plural orifices has a flap that is attached to the orifice plate. The flaps may be attached directly to and bent from the orifice plate as in prior designs, or they may be attached to the orifice plate through plugs in the orifices. At least one orifice of the orifice plate may be closed by a removable plug. The pump speed is adjustable by the number of holes that are plugged, to be closed or partially blocked by flaps.

In various applications, the combined louvers and orifice plate extend substantially across the entire frontal opening, at least 90% of the radius of the frontal opening. Alternatively, a substantial open space may surround the orifice plate or be provided between the louvers and the orifice plate.

Plural orifice plates may surround the louvers. The louvers and plural plates may span substantially the entire frontal opening, or spaces may be provided, including a space between orifice plates.

In a conventional cylindrical arrangement of a cryopump, the louvers are circular and the orifice plate surrounds the louvers and has a circular array of orifices therein. Plural circular arrays of orifices of different sized orifices may be provided. In one embodiment, an inner circular array of orifices comprises flaps that are bent from and attached to the orifice plate at an edge of each orifice, and an outer circular array comprises open orifices without flaps.

Although the plate surrounding the louvers may be solid, in most embodiments it has at least one orifice therein. The orifice may be a through hole surrounded by the plate or a cutout on an edge of the plate. The cutout may be on either the outer or inner edge of the plate or both. Alternatively or in addition, flow paths past the plate may be defined by an undulating edge. The undulation may be on either the inner edge or outer edge or both.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1A:
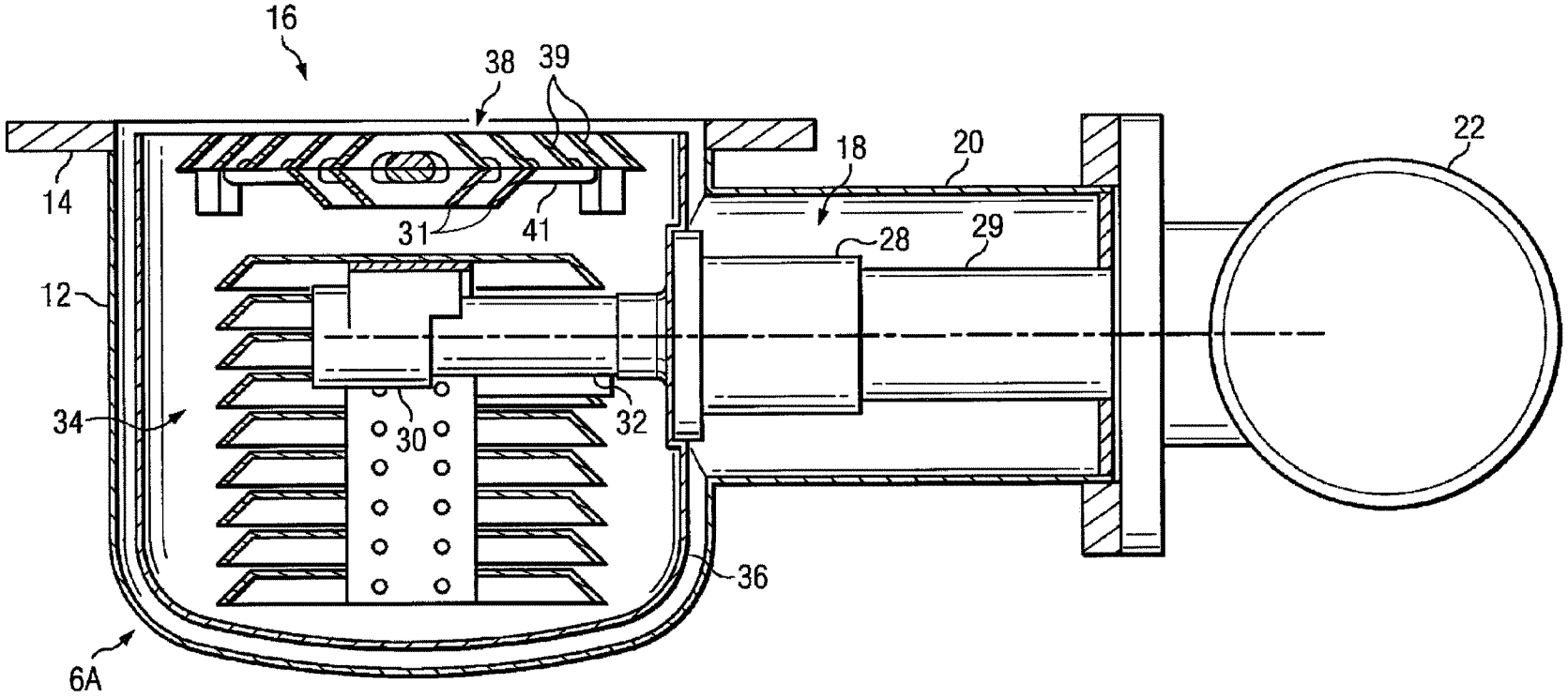
FIG. 1A (PRIOR ART)
FIG. 1A is a side view cross-section of a prior art cryopump.
Figure 1B:
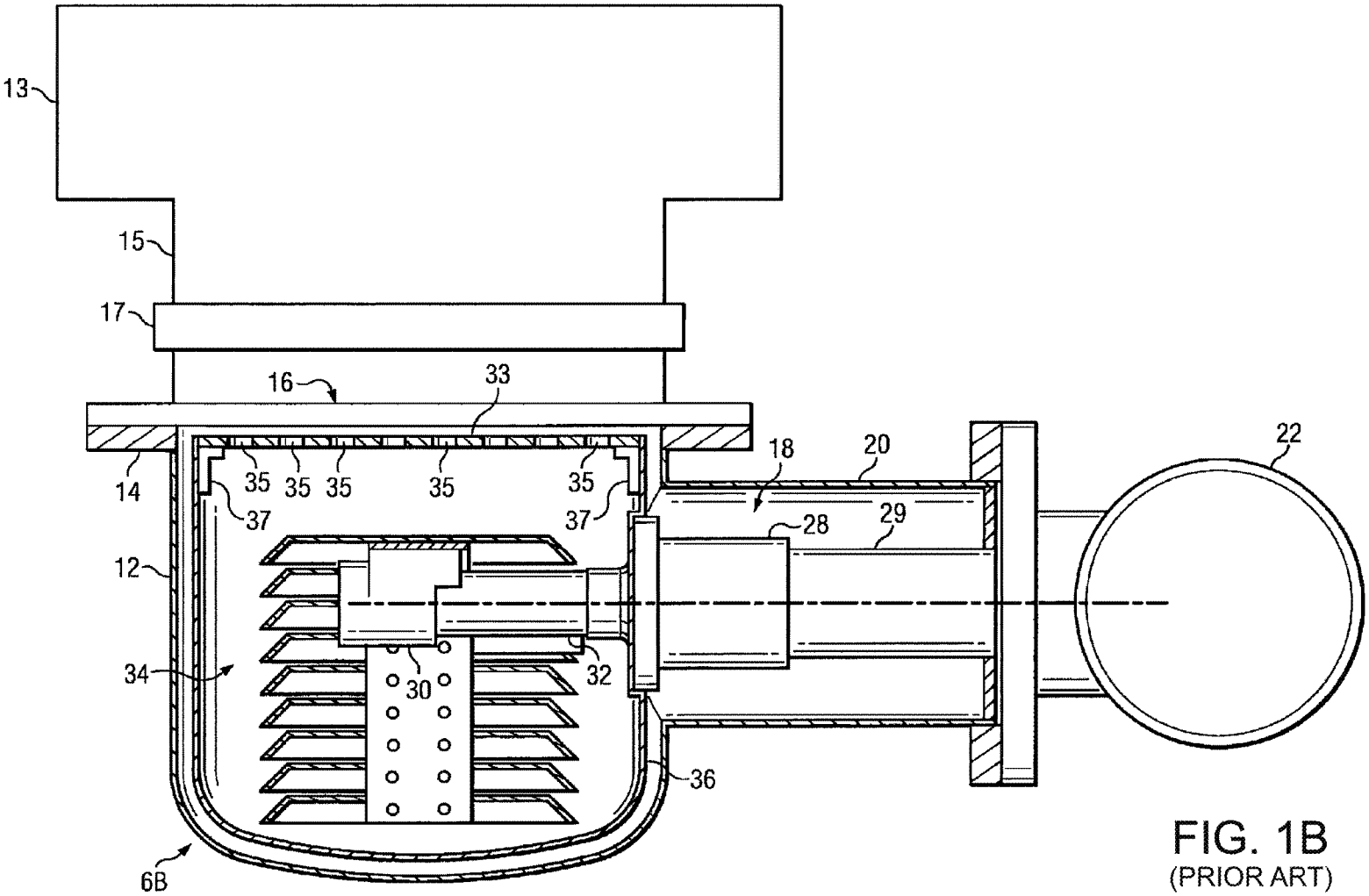
FIG. 1B (PRIOR ART)
FIG. 1B is a side view cross-section of another prior art cryopump.

Cross-section side views of prior art circular cryopumps 6A and 6B attached to a process chamber 13 are shown in FIGS. 1A and 1B, respectively. Each cryopump 6A and 6B includes a cryopump housing 12 which may be mounted either directly to the process chamber along flange 14 or to an intermediate gate valve 17 between it and the process conduit 15 which is connected to the process chamber 13. The conduit 15 includes a gate valve 17 which may be employed to isolate the cryopump 6 from the process chamber 13. The cryopumps 6A and 6B are capable of pumping the process chamber 13. The cryopumps 6A and 6B include a cryopump housing 12 bolted to conduit 15, which is coupled to the process chamber 13. The front opening 16 in the cryopump housing 12 communicates with the circular opening in the process chamber 13. A two stage cold finger 18 of a refrigerator protrudes into the cryopump housing 12 through a cylindrical portion 20 of the vessel. The refrigerator may be a Gifford-McMahon refrigerator as disclosed in U.S. Pat. No. 3,218,815 to Chellis et al. A two stage displacer in the cold finger 18 is driven by a motor 22. With each cycle, helium gas introduced into the cold finger under pressure is expanded and thus cooled and then exhausted through a line. A first stage heat sink or heat station 28 is mounted at the cold end of the first stage 29 of the refrigerator. Similarly, a heat sink 30 is mounted to the cold end of the second stage 32.

A primary pumping surface is a second stage array 34 mounted to the second stage heat station 30. This array is preferably held at a temperature below 20 K in order to condense low condensing temperature gases. A cup-shaped radiation shield 36 is joined to the first stage heat station 28. The second stage 32 of the cold finger extends through an opening in the radiation shield. This shield surrounds the second stage array 34 to the rear and sides of the array to minimize heating of the array by radiation. Preferably, the temperature of this radiation shield is less than about 130 K.

FIG. 1A shows a frontal cryopanel array 38 that serves as both a radiation shield for the second stage array 34 and as a cryopumping surface for higher boiling temperature gases such as water vapor. This array comprises louvers 39 joined by radial support rods 41. The supports rods 41 are mounted to the radiation shield 36. The radiation shield 36 both supports the frontal cryopanel array 38 and serves as the thermal path from the heat sink 28 to the frontal cryopanel array 38. The louvers may be chevrons at the center, 31, as shown.

FIG. 1B shows another frontal cryopanel design, which includes a frontal baffle plate or sputter plate 33 which is in thermal contact with the radiation shield 36, serving as both a radiation shield for the second stage pumping area and as a cryopumping surface for higher boiling temperature gases such as water vapor. The frontal baffle plate 33 is attached to the radiation shield 36 by brackets 37. The frontal baffle plate 33 has a plurality of orifices 35 which restrict flow of lower boiling point temperature gases to the second stage array.

The frontal baffle plate acts in a selective manner because it is held at a temperature approaching that of the first stage heat sink (between 50 K and 130 K). While the higher condensing temperature gases freeze on the baffle plate itself, the orifices 35 restrict passage of these lower condensing temperature gases to the second stage. As described above, by restricting flow to the inner second stage pumping area, a percentage of inert gases are allowed to remain in the working space to provide a moderate pressure (typically $10^{-3}$ Torr or greater) of inert gas for optimal sputtering. To summarize, of the gases arriving at the cryopump port 16, higher boiling temperature gases are removed from the environment by condensation on the frontal baffle plate while the flow of lower temperature gases to the second stage pumping surface is restricted. The flow restriction results in higher pressure in the working chamber. The level of flow restriction can be controlled by design of the number and sizes of the orifices and can be adjusted by plugging individual orifices as disclosed in U.S. Pat. No. 4,611,467.

Figure 2:
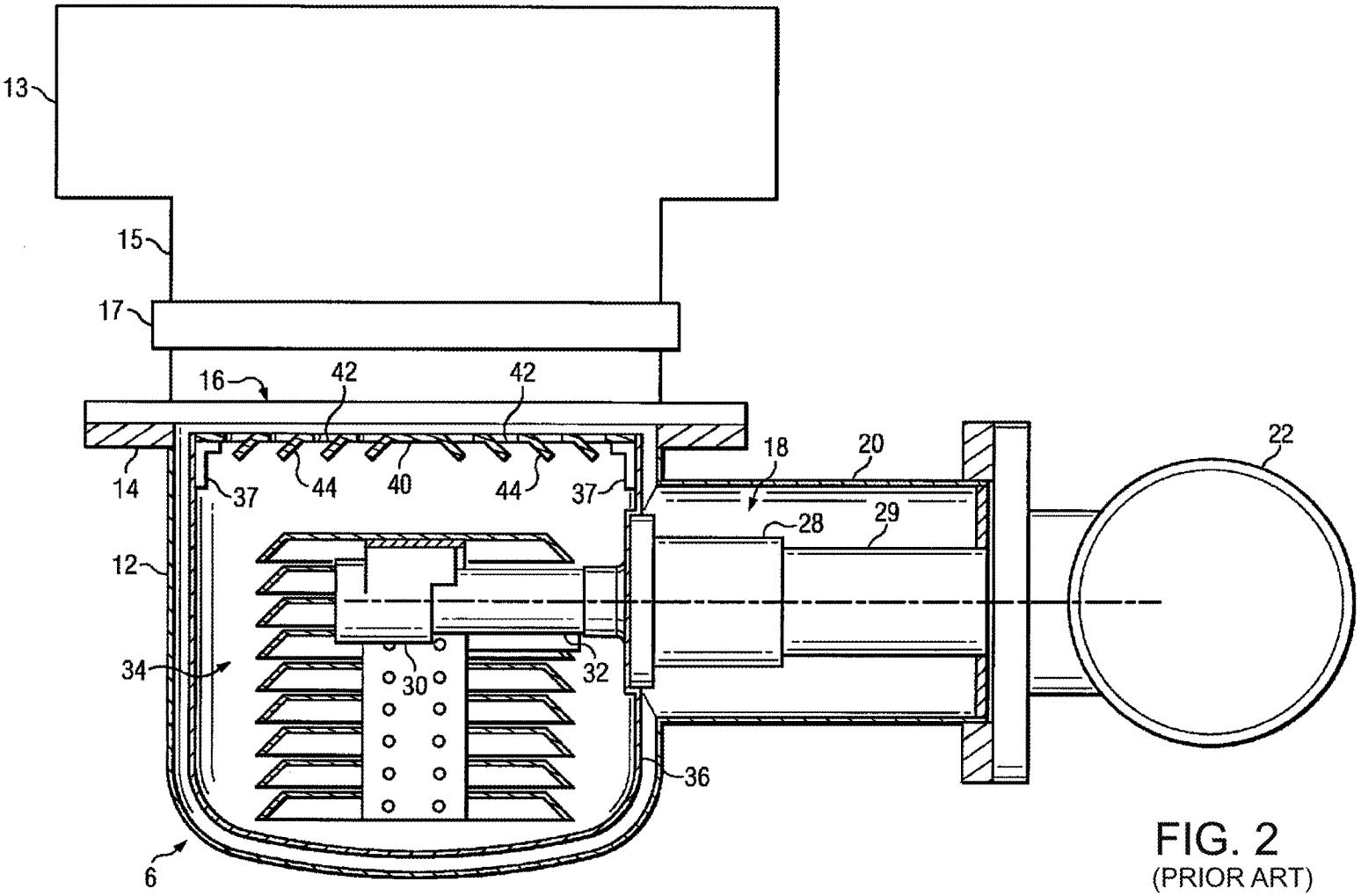
FIG. 2 (PRIOR ART)
FIG. 2 is a side view cross-section of a cryopump having an embodiment of a frontal baffle plate.
Figure 3A:
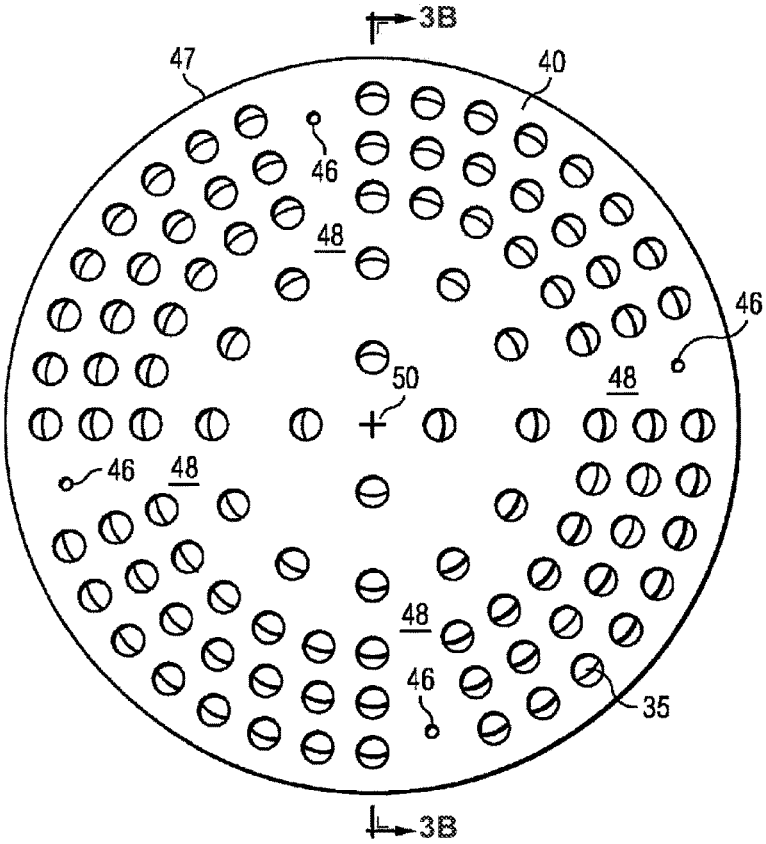
FIG. 3A (PRIOR ART)
FIG. 3A is a top view of an embodiment of a frontal baffle plate having circular orifices.
Figure 3B:
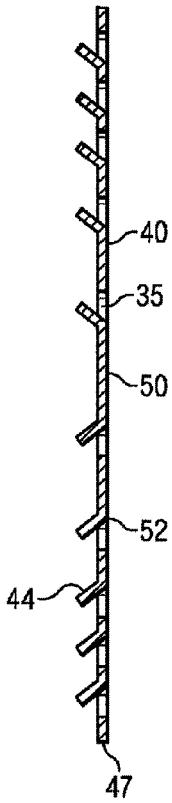
FIG. 3B (PRIOR ART)
FIG. 3B is a side view cross-section of the embodiment of the frontal baffle plate shown in FIG. 3A.

FIG. 2 shows a circular cryopump 7 having an embodiment of a frontal baffle plate 40, and FIGS. 3A and 3B show the frontal baffle plate 40 isolated from the cryopump. The frontal baffle plate 40 has a plurality of orifices 42, each orifice 42 having a flap 44 associated with it. FIG. 3A shows a top view of the frontal baffle plate 40. The frontal baffle plate 40 carries a plurality of orifices 35. The frontal baffle plate 40 also may carry a plurality of holes 46 that can receive rivets, screws, or other fasteners (not shown) to attach the frontal baffle plate 40 to brackets 37. In the embodiment that is shown, the plurality of orifices 35 are arranged on the frontal baffle plate 40 in a pattern that provides regions 48 that have no orifices 35. These regions 48 allow for higher thermal conductance between the center 50 of the frontal baffle plate 40 and the holes 46 and the perimeter 47 of the frontal baffle plate 40. Generally, the frontal baffle plate 40 is thermally coupled to the radiation shield—at the brackets 37 via holes 46, and also may be coupled at the perimeter 47 where the frontal baffle plate 40 is in contact with the radiation shield 36. FIG. 2 shows the frontal baffle plate 40 nestled within the radiation shield 36. Alternatively, the frontal baffle plate 40 can be arranged on top of the radiation shield 36. FIG. 3B shows a side view cross-section of the frontal baffle plate 40 at section A-A shown in FIG. 3A. Each orifice 35 in the frontal baffle plate 40 has a flap 44. Each flap 44 is attached to the frontal baffle plate 40 at an edge 48 of its respective orifice 35.

Figure 3C:
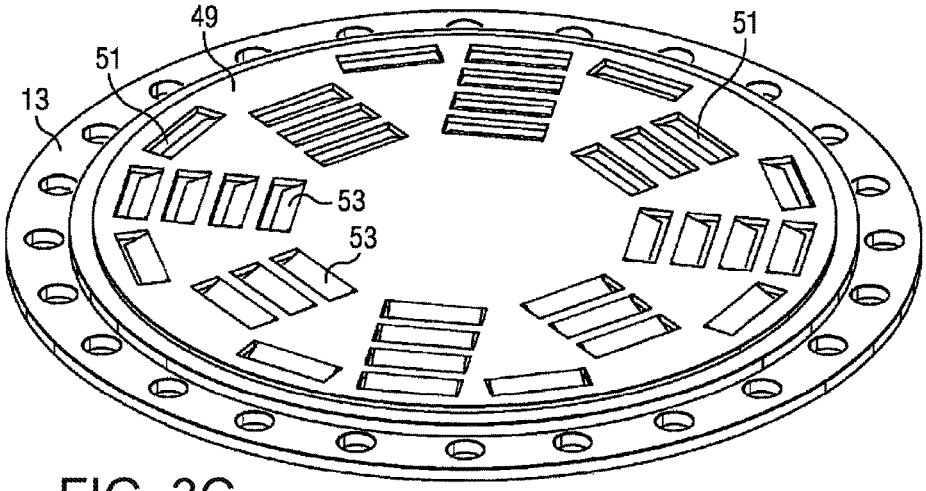
FIG. 3C (PRIOR ART)
FIG. 3C is a top view of an embodiment of a frontal baffle plate having rectangular orifices.

FIG. 3C shows a perspective view of an alternate embodiment of a frontal baffle plate 49 for a circular cryopump having rectangular orifices 51. FIG. 3C shows the frontal baffle plate 49 from the side that faces a process chamber 13. Each rectangular orifice 51 has an associated flap 53 attached at a fold line 55. The fold line 55 for each orifice 51 is at an edge of the orifice closest to the center of the frontal baffle plate 49 such that an unblocked path from the process chamber 13 to the second stage array 34, through the orifices 51, goes radially outward from the center of the frontal baffle plate. This radial outward path directs the relatively hot gas flow from the process chamber away from first striking the second stage array 34, reducing the heat load on the array of baffles. The radial outward path also reduces the radiation load on the second stage array 34 because the radiation also is directed away from the second stage array 34.

Generally, increasing the number of orifices 35 on the frontal baffle plate 40 and evenly distributing the orifices 35 on the frontal baffle plate 40 results in the Type II gases passing through the orifices 35 more evenly impinging on the second stage array 34 in a cryopump. However, increasing the number of orifices 35 of a given size and evenly spacing the orifices 35 reduces the size of regions 48 without orifices 35, reducing the heat conductance of the frontal baffle plate 40, which can increase the temperature of the frontal baffle plate 40 in an operating cryopump. Also, increasing the number of orifices 35 may require smaller orifices 35, and smaller orifices 35 are more susceptible to being clogged by condensing gases.

Figure 4:
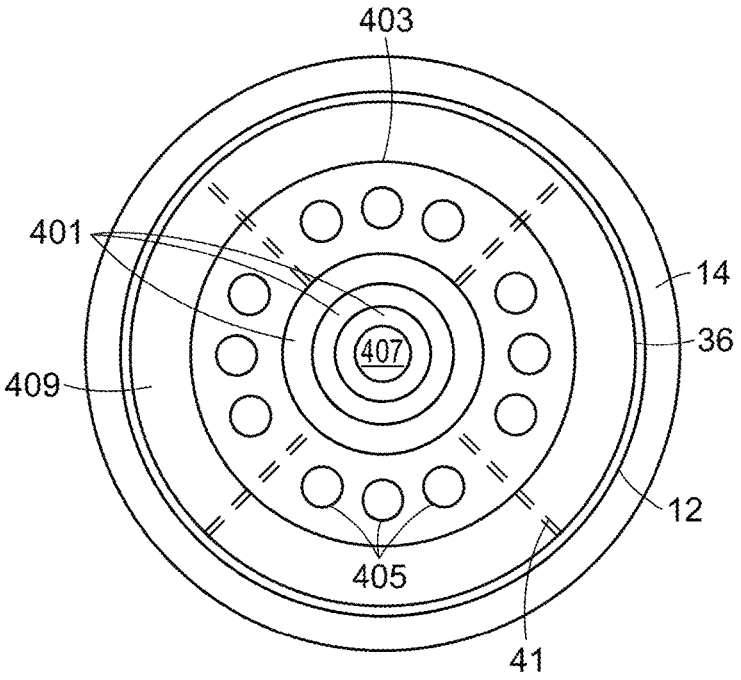
FIG. 4 is a plan view of a hybrid frontal array of the cryopump in which an orifice plate is spaced from the radiation shield and surrounds louvers.

FIG. 4 is a plan view of a hybrid frontal array in a cryopump embodying the present invention. The cryopump may be, for example, as shown in FIGS. 1 and 2 but with the frontal array replacing the frontal arrays of those figures. Relative to the frontal arrays of FIGS. 1-3, the hybrid frontal array provides increased pumping speed of type II and III gases because of the open space 409 but offers less adjustment for pumping speed due to the reduced number of orifices. In particular, a cylindrical radiation shield 36 is provided within a vacuum vessel 12 having a flange 14. Similar to conventional frontal arrays, the frontal array may be mounted to the radiation shield through thermal rods 41. Louvers 401 are provided in a center region of the frontal opening of the radiation shield and are mounted on the thermal rods. The center of the louvers is blocked by a disk 407. Surrounding the louvers 401 is an orifice plate 403 having, in this case, 12 orifices 405 therein. The number, shape and sizes of the orifices are designed to provide appropriate pump speed while minimizing radiation that passes through the plate to the second stage array. Orifices 405 can be of any shape or dimension. Orifices 405 can be circular, polygonal, irregular, symmetric, asymmetric, or any combination thereof. All orifices can be of the same shape and/or dimension or the orifices can have a variety of shapes and/or dimensions. While the cryopumps and frontal arrays illustrated in the Figures are generally cylindrical in shape, any shape cryopump and frontal array can be used in practicing the invention including, but not limited to, those with circular and polygonal (e.g., square or rectangular) cross sections. In some embodiments, cryopump configurations that extend into the process space, such as wherein one or more of the arrays extend into the process space, can be used.

The orifice plate may extend close to the radiation shield such that the louvers and orifice plate cross substantially the entire frontal opening. For example, the orifice plate may have a largest dimension (e.g., a diameter) of at least about 90% of a largest dimension (e.g., the diameter) of the frontal opening. However, in the embodiment shown in FIG. 4, a substantial open space 409 is provided between the orifice plate and the radiation shield. For example, the orifice plate may extend only about 70-80% of the largest dimension of the frontal opening. The open space allows for the free flow of gas therethrough, but does not substantially increase the radiation that passes to the second stage array. The second stage array is hidden behind the louvers and orifice plate, which will block a substantial amount of the radiation that is projected along an axis parallel to the center axis of the pump. Radiation that enters the open space parallel to the center axis will bypass the second stage away and reach the base of the radiation shield. Radiation that enters the open space at an angle toward the center will see a much smaller projected area of the open space. In some embodiments, the width of the substantial open space 409 (i.e., the radial distance between the orifice plate and the radiation shield) is at least as wide as about the distance between adjacent louvers or at least as wide as about the twice the distance between adjacent louvers. In particular embodiments, the width of the substantial open space 409 is at least about 5%, 10%, 15%, or at least about 20% of a largest dimension (e.g., the diameter) of the frontal opening.

FIGS. 5A-5F show various views of the frontal array of FIG. 4 mounted on the thermal rods 41. However, in these views, the thermal rods 41 are replaced by beams 416 and only two louvers 401 are provided.

Figure 5A:
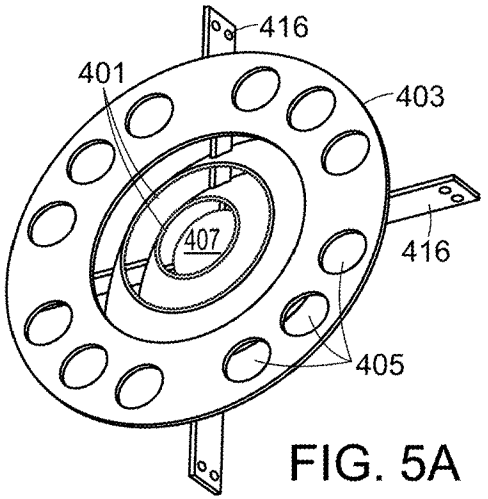
FIGS. 5A-5F show the hybrid frontal array of FIG. 4 in several orientations.
Figure 5B:
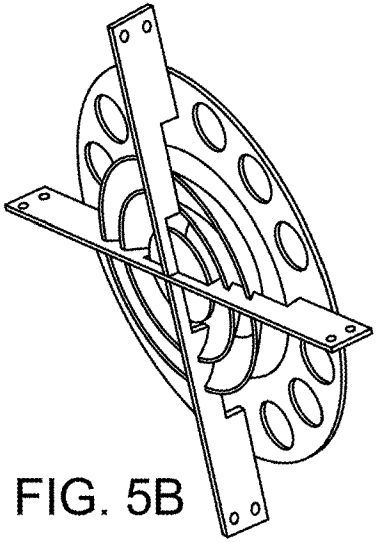
Figure 5E:
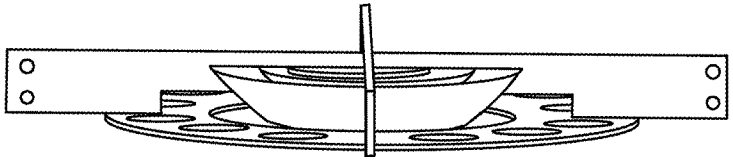
Figure 5C:
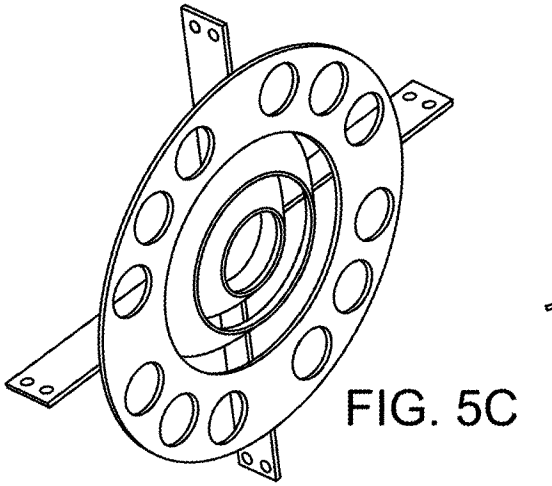
Figure 5D:
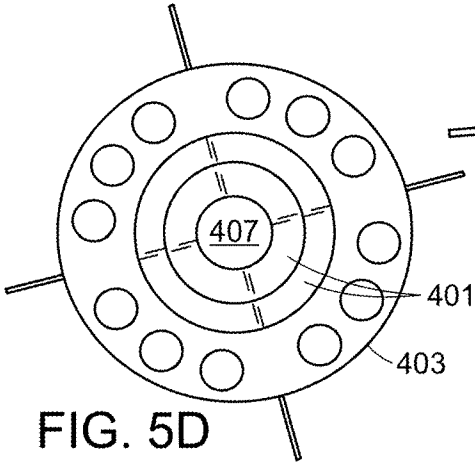
Figure 5F:
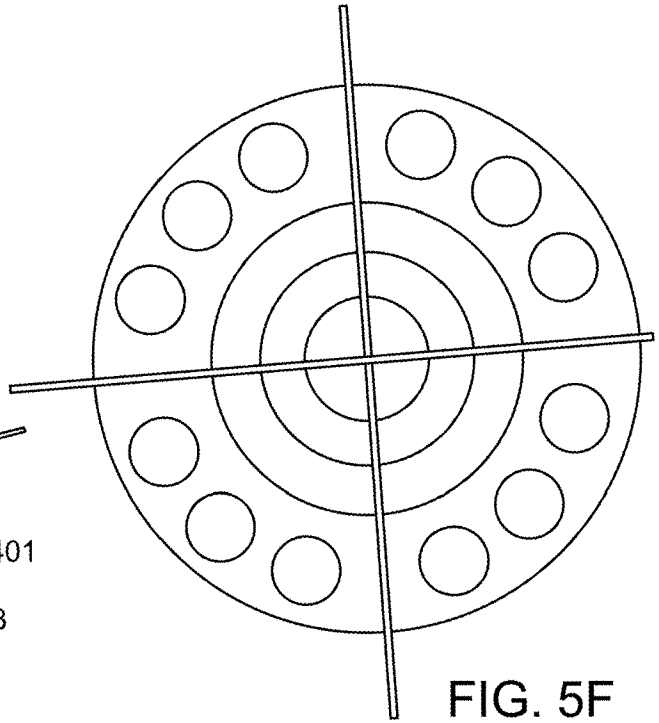

FIG. 5A shows a perspective top view of the array. FIG. 5B shows a perspective bottom view of the array. FIG. 5C shows a perspective top view of the array from a different angle. FIG. 5D shows a top view of the array showing that the center disk 407 and louvers 401 completely close the center region of the array as viewed from above. FIG. 5E illustrates a bottom perspective view of the array. FIG. 5F shows a bottom view of the array.

Figure 6:
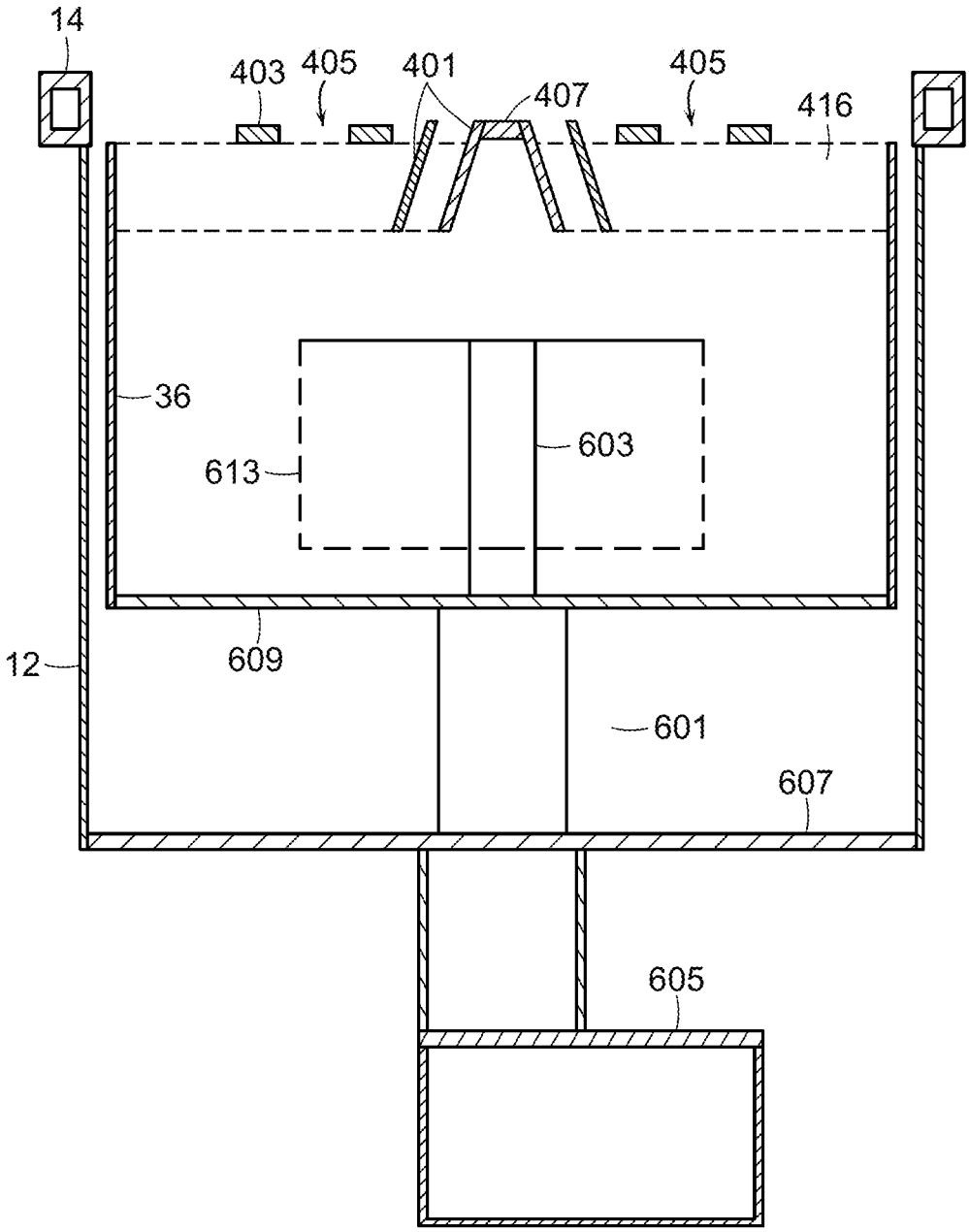
FIG. 6 is a cross-sectional view of a cryopump having a hybrid frontal array similar to that of FIG. 4.
Figure 7:
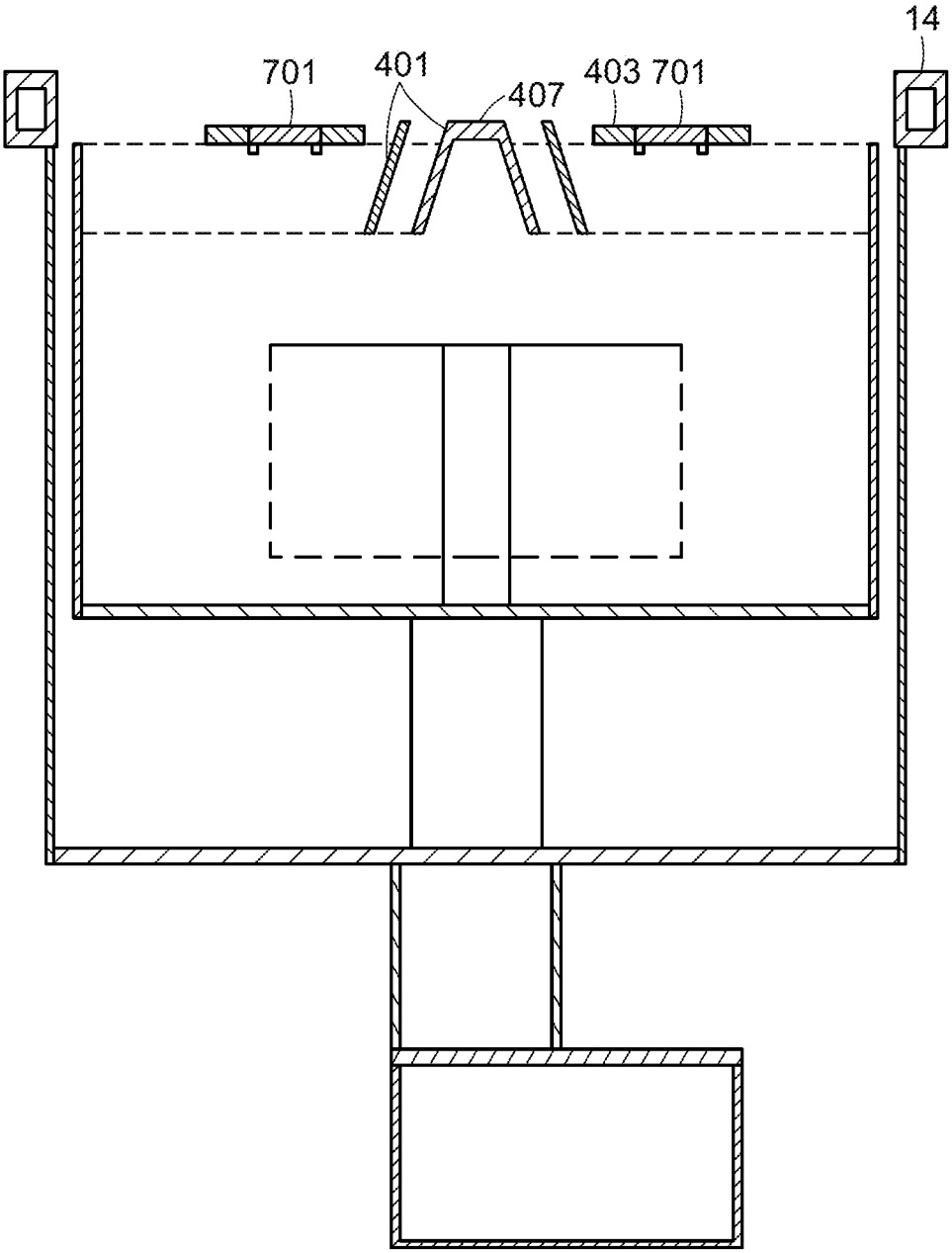
FIG. 7 is a cross-sectional view of a cryopump having a hybrid frontal array as illustrated in FIG. 6 but with holes of the orifice plate plugged.

FIG. 6 shows a cross-sectional view of a cryopump having the hybrid frontal array of FIGS. 5A-F. Unlike the cryopump of FIGS. 1 and 2, the refrigerator is mounted to pass through the bottom of the vacuum vessel and radiation shield; however, the mounting configuration of the refrigerator is not essential to the present invention and the side mounted refrigerator of FIGS. 1 and 2 (along with other known configurations) is equally useful for practice of the invention. A two-stage refrigerator coldfinger includes a first stage 601 and a second stage 603 driven by a motor 605. The second stage 603 cools the second stage array 613. The second stage array 613 is shown in broken lines to indicate that it may take any form including that of FIGS. 1 and 2. The first stage 601 extends through the vacuum vessel 607 and supports and cools the base 609 of the radiation shield. The base 609 cools the cylindrical sides of the radiation shield 36 and the frontal array. Again, the frontal array includes supporting beams 416 that support a center disk 407, louvers 401, and an orifice plate 403 having orifices 405. FIG. 7 shows a similar cross-sectional view but with plugs 701 closing two of the orifices of the orifice plate 403.

Any number of holes may be plugged to adjust the pumping speed with respect to any desired gas of the process and to also adjust the level of thermal radiation that may pass through the frontal array to the second stage array. With the center louvers, the gas transmission probability to the second stage array through the frontal array is, with all holes open, very close to that of a conventional louvered array and substantially higher than that of the standard sputter plate. Unlike the conventional louvered array, the process gas pump speed can be adjusted by plugging holes or controlled by designing appropriate orifice plates for particular applications. In particular, the pump speed for Type II and Type III gases can be easily adjusted with the plugs.

Figure 8:
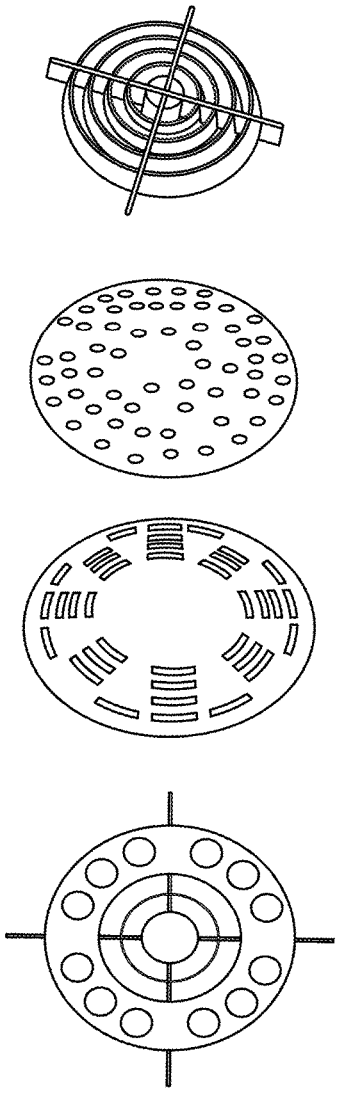
FIG. 8 is a table providing a comparison between several frontal array designs including the hybrid frontal array.

FIG. 8 presents a comparison of the hybrid frontal array, shown in the last row of the table, against a conventional louver array (first row), sputter plate with open orifices (second row), and a baffle plate having rectangular orifices and bent flaps (third row). As can be seen in column one, conventional louvers and the hybrid array both provide high pump speed of Type II and Type III gases. As will be discussed below, the pump speed of the hybrid array is very near to that of the louvered array.

As can be seen in the second column of FIG. 8, only the sputter plate suffers a significant increase in heat load to the second stage array. With the sputter plate, that load results primarily from the open holes directly over the second stage array. By contrast, the louvered array and hybrid array both have louvers that reflect radiation toward the walls of the radiation shield that can absorb the heat load. The baffle plate shown has a large closed area over the second stage array and reflecting baffles at the orifices. Although both the sputter plate and the hybrid array have outer orifices that pass radiation, the radiation would either pass parallel to the axis of the system toward the back surface of the radiation shield or would be angled and thus see small projected areas of the orifices.

Gas capacity, that is the amount of the condensed and absorbed gas that can be held on the second stage array, is inversely related to the temperature of the second stage array which is inversely related to the amount of radiation passing directly to the second stage array through the frontal array. As a consequence, it can be seen in column 3 that the baffled orifice plate has the highest capacity. That is because that array provides virtually no line of sight to the second stage array due to the closed center region and baffles at the orifices. However, the capacity of the hybrid array can be increased by plugging the orifices with closure plugs or with baffle plugs at a cost of pump speed. Again, the hybrid with its center louvers and orifice plate allows for reasonably low heat load close to that of conventional louvers but allows that heat load and speed to be adjusted using plugs. This adjustability is illustrated in column 4.

In a cryopump, water is a Type I gas that will pump on any surface. Type II gases pump anywhere in the second stage array and include such gases as oxygen, nitrogen and argon. Type III gases pump only on the charcoal of the second stage array and include such gases as hydrogen, neon and helium. Typical process gases can include, for example, argon and krypton. It can be desirable to limit the pump speed of process gas to minimize the amount that must be supplied to the process, to better maintain a desired partial pressure of those gases in the system, and/or to reduce the time before pump regeneration is necessary. On the other hand, the process gas may share the same pumping surface as process contaminants such as oxygen, nitrogen, and hydrogen for which a high pumping speed is desirable. Accordingly, design and adjustment of the frontal array can be a balance to obtain high pumping speed of contaminants while obtaining an acceptable pumping speed of process gases. For example, through adjusting the frontal array as described herein, one can start with the highest possible pump speed for both process gas and process contaminant gas(es) and then adjust the frontal array to reduce process gas pump speed until a desired process gas partial pressure is achieved in the process space.

Figure 9:
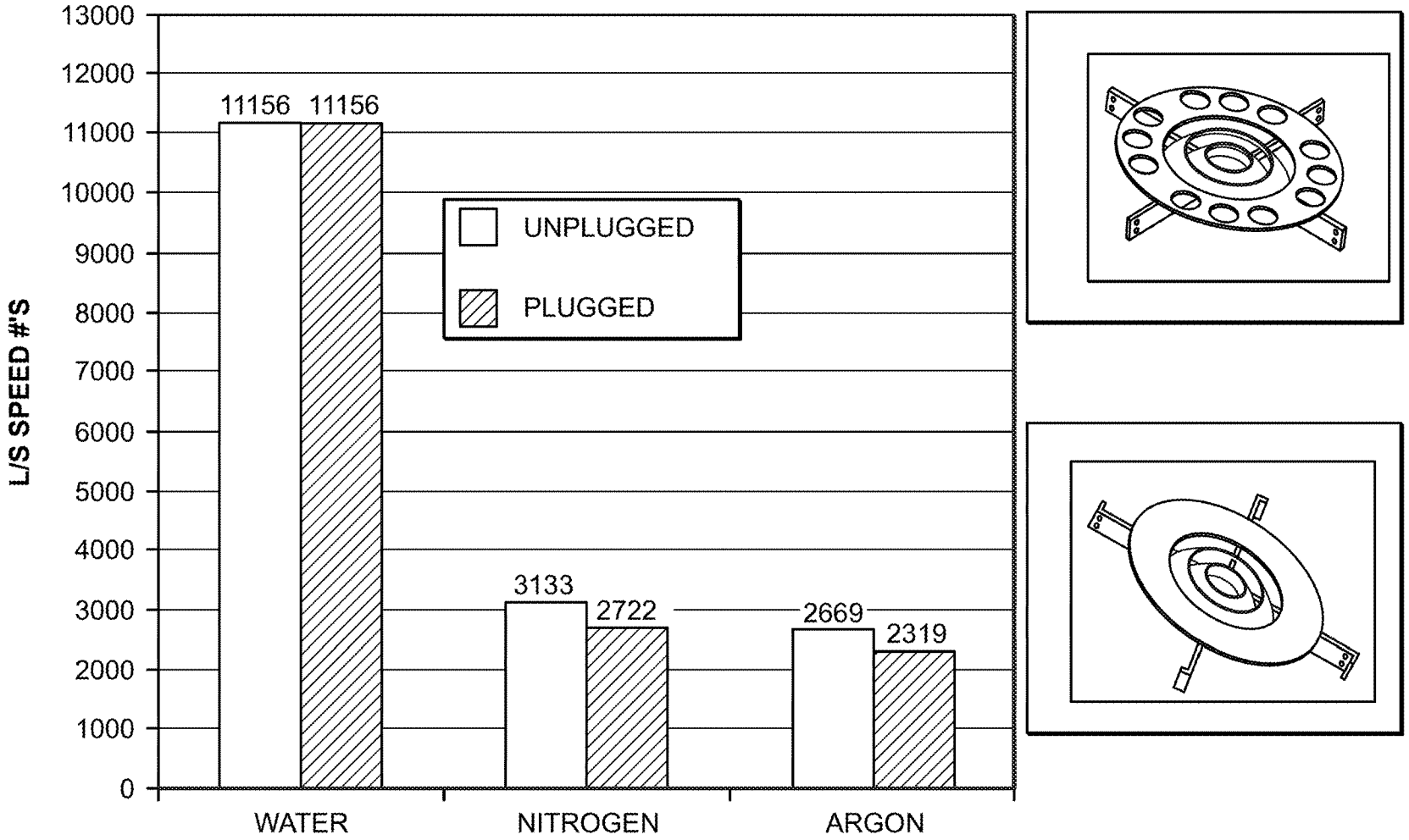
FIG. 9 provides a comparison of pumping speed of the frontal array of FIG. 4 with all orifices either unplugged or plugged.

FIG. 9 shows computer simulated pumping speed for water, nitrogen and argon of the hybrid array with all orifices open and with all orifices plugged. The pumping speed for each gas with the open orifices is very close to that of a conventional louver frontal array (not shown). On the other hand, it can be seen that there is adjustability in the pumping speed of nitrogen and argon by selectively closing orifices. In particular, in the simulation of one embodiment, a louver frontal array with unplugged orifices provides about 2700 liters per second for argon. Since argon is a typical process gas, adjustability for that gas is significant.

Figure 10:
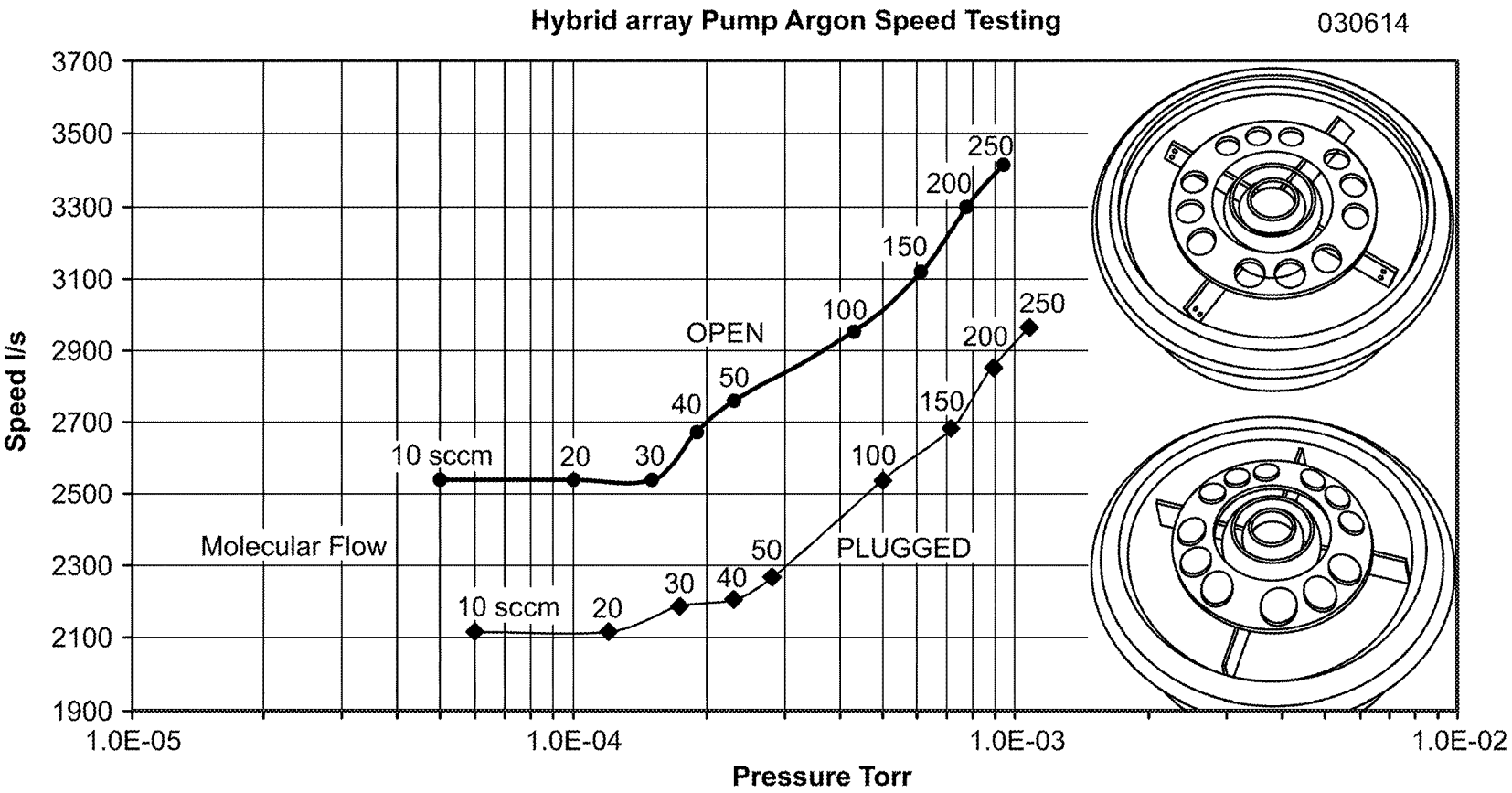
FIG. 10 provides test data for pump speed for argon with the orifice plates both unplugged and plugged.

FIG. 10 shows pump speeds of argon at different pressures for one hybrid array with all orifices open and with all orifices closed. Speeds will differ depending on size and design. It can be seen by comparison to FIG. 9, which shows computer simulation results at low pressures, that the model of FIG. 9 can be used as a predictor of the actual data of FIG. 10. Thus, the hybrid array allows for rapid modeling of a particular array design based on computer simulation without the need for extensive tests.

Figure 11:
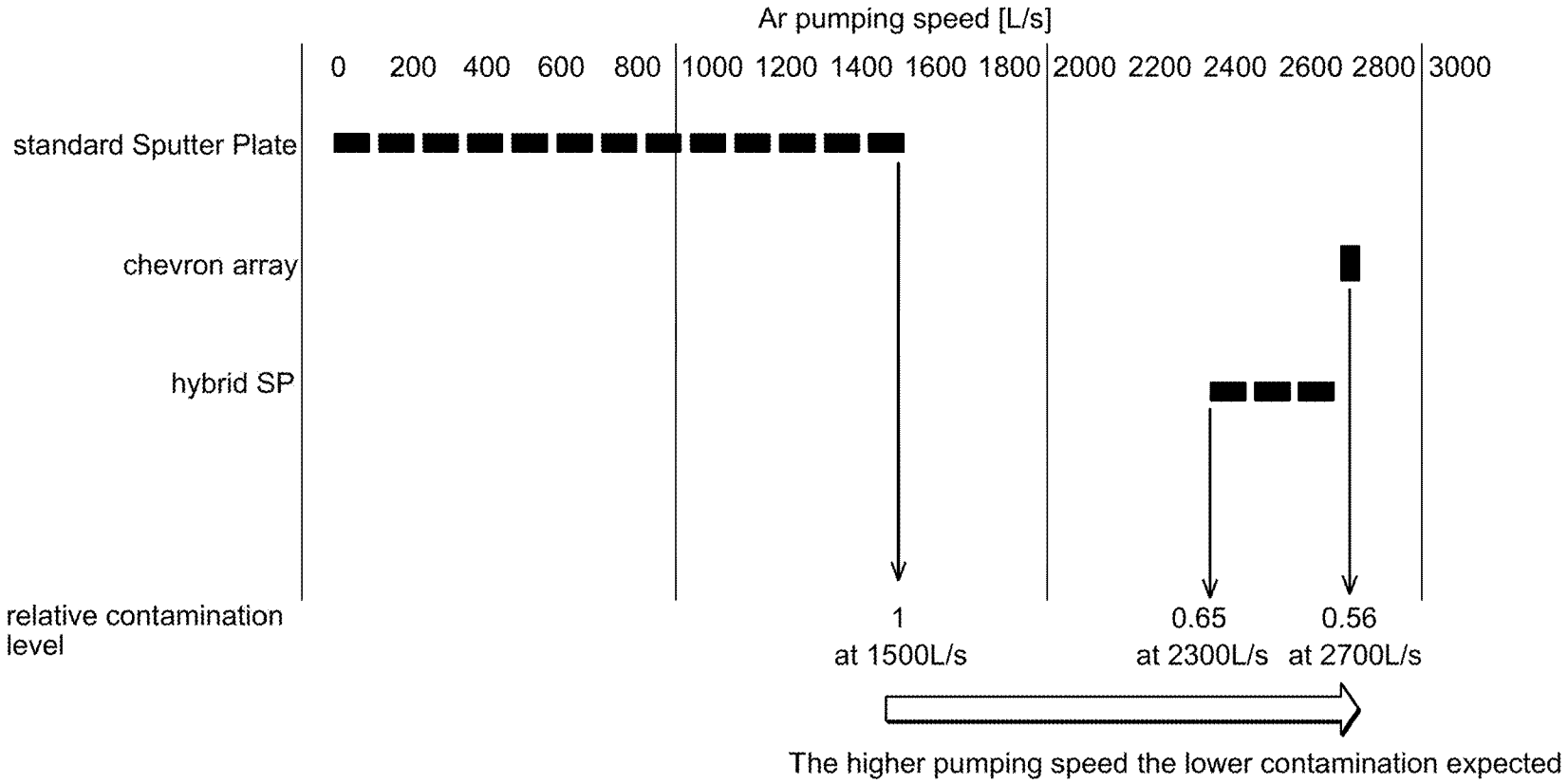
FIG. 11 compares argon pumping speed for a prior splutter plate, a chevron frontal array, and the hybrid frontal array.

FIG. 11 compares the performance of the standard sputter plate with that of a chevron louvered array and a hybrid array. The chevron array can be seen to provide the highest argon pumping speed. The conventional sputter plate, while providing a wide range of adjustability, has a maximum pumping speed that is substantially less than that of the louvered array, about 1500 liters per second as opposed to 2700 liters per second. Although the argon pumping speed of the hybrid array is a bit less than that of the chevron array, it is very close. Further, it has adjustability down to about 2300 liters per second. Thus, the hybrid provides limited adjustability with nearly the same maximum pumping speed as the chevron array. The highest pump speed maximizes pumping of contaminants. On the other hand, lower pump speed will allow conservation of process gases at the cost of not pumping contaminants as rapidly. Although not shown, the baffle array would have much lower pumping speed in return for lower heat load.

The remaining figures show several alternatives of hybrid arrays.

Figure 12:
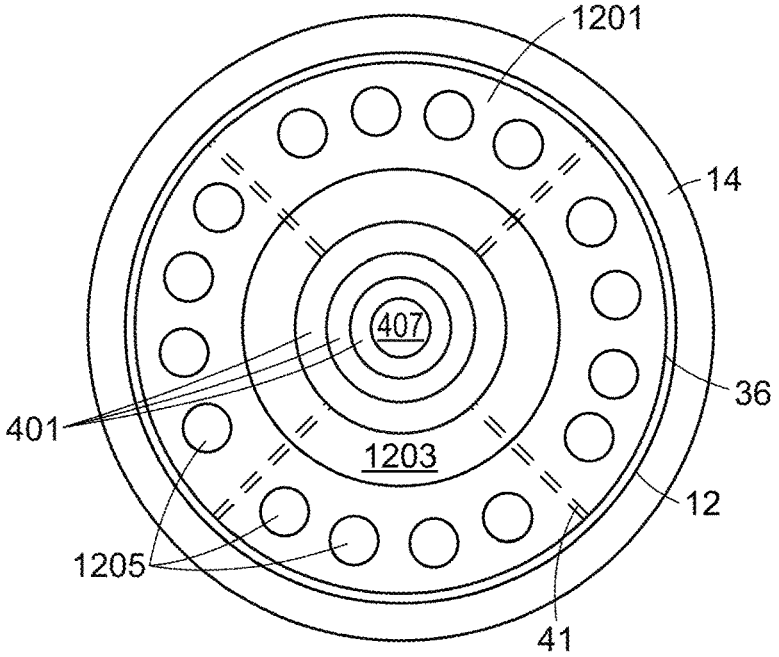
FIG. 12 illustrates an alternative hybrid frontal array in which a space is provided between the louvers and orifice plate.
Figure 13:
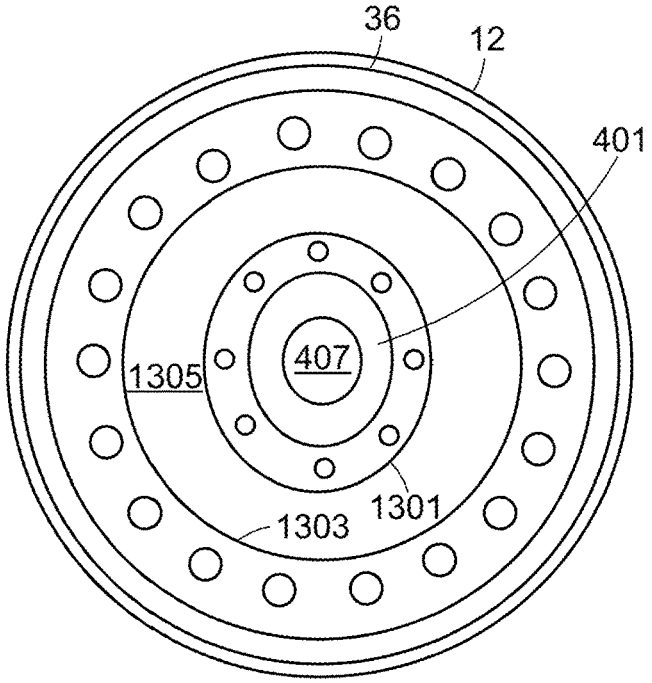
FIG. 13 illustrates an alternative hybrid array having two orifice plates and an open space therebetween.

The embodiment of FIG. 12 includes a center disk 407 and centered louvers 401 as in FIG. 4. However, in this embodiment the orifice plate 1201 is larger with the outer diameter close to that of the radiation shield and an inner diameter larger than the louvers to leave a middle open space 1203. In this and other embodiments, an outer orifice plate may extend to the radiation shield as shown in FIG. 2 or may be spaced from it as shown in FIG. 13. The larger diameter orifice plate allows for a greater number of orifices 1205 and thus greater adjustability; however, the open space is now closer to the center, allowing more radiation to reach the second stage array. The open space is also smaller, decreasing the pump speed for type II and III gases.

The embodiment of FIG. 13 includes two orifice plates 1301 and 1303 separated by open space 1305. The smaller orifice plate 1301 includes smaller orifices. The larger orifices of the outer plate 1303 provide for a course adjustment with plugs; whereas, the smaller orifices in the inner plate 1301 provide for finer adjustment with plugs. The arrays are generally similar but appear oval as tilted. However, they may in face be oval or array other shape.

Figure 14:
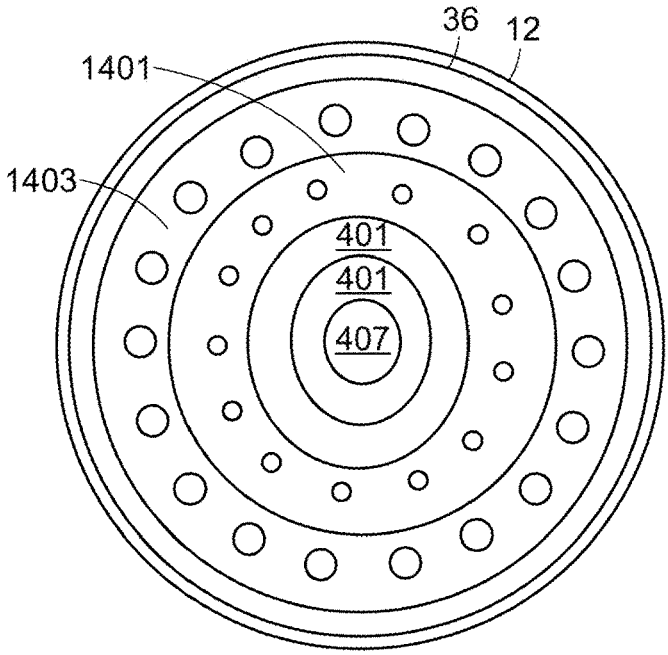
FIG. 14 illustrates an alternative embodiment having two orifice plates surrounding louvers with minimal open space.

FIG. 14 includes two orifice plates 1403 and 1401, each with different sized orifices, that with the louvers substantially cross the frontal opening of the radiation shield.

Figure 15:
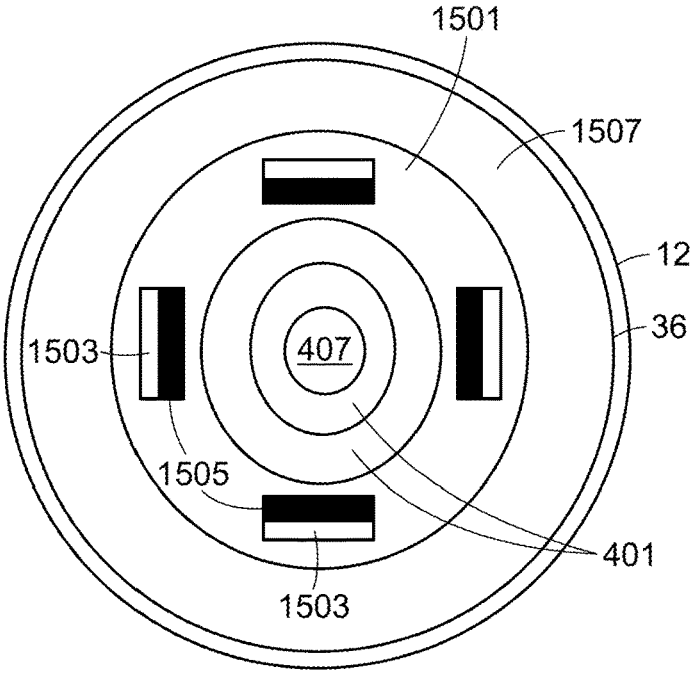
FIG. 15 illustrates an embodiment of the hybrid array in which the orifice plate is a baffle plate'

FIG. 15 shows a baffled orifice plate 1501 surrounding the louvers 401 and an open space 1507 surrounding the baffled orifice plate. Each orifice 1503 includes a baffle (flap or wing) 1505 bent from the orifice plate to direct radiation outwardly toward the radiation shield. This design provides significant design flexibility, but not the in-place adjustability of open holes that can be plugged.

Figure 16:
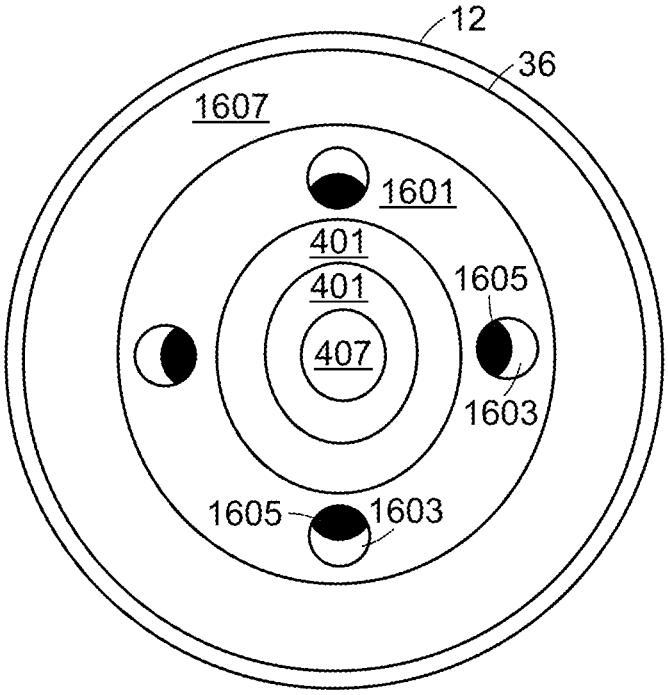
FIG. 16 is an embodiment of the hybrid array in which the orifice plates is a baffle plate having circular orifices.

FIG. 16 shows an embodiment in which the louvers 401 are surrounded by an orifice plate 1601 having circular orifices 1603 with flaps (baffles) 1605 directing radiation outwardly toward the radiation shield. As in the embodiment of FIG. 15, an open space 1607 is provided outside of the orifice plate. Similarly, this design can be designed to control pump speed but is limited in its on-site adjustability.

Figure 17:
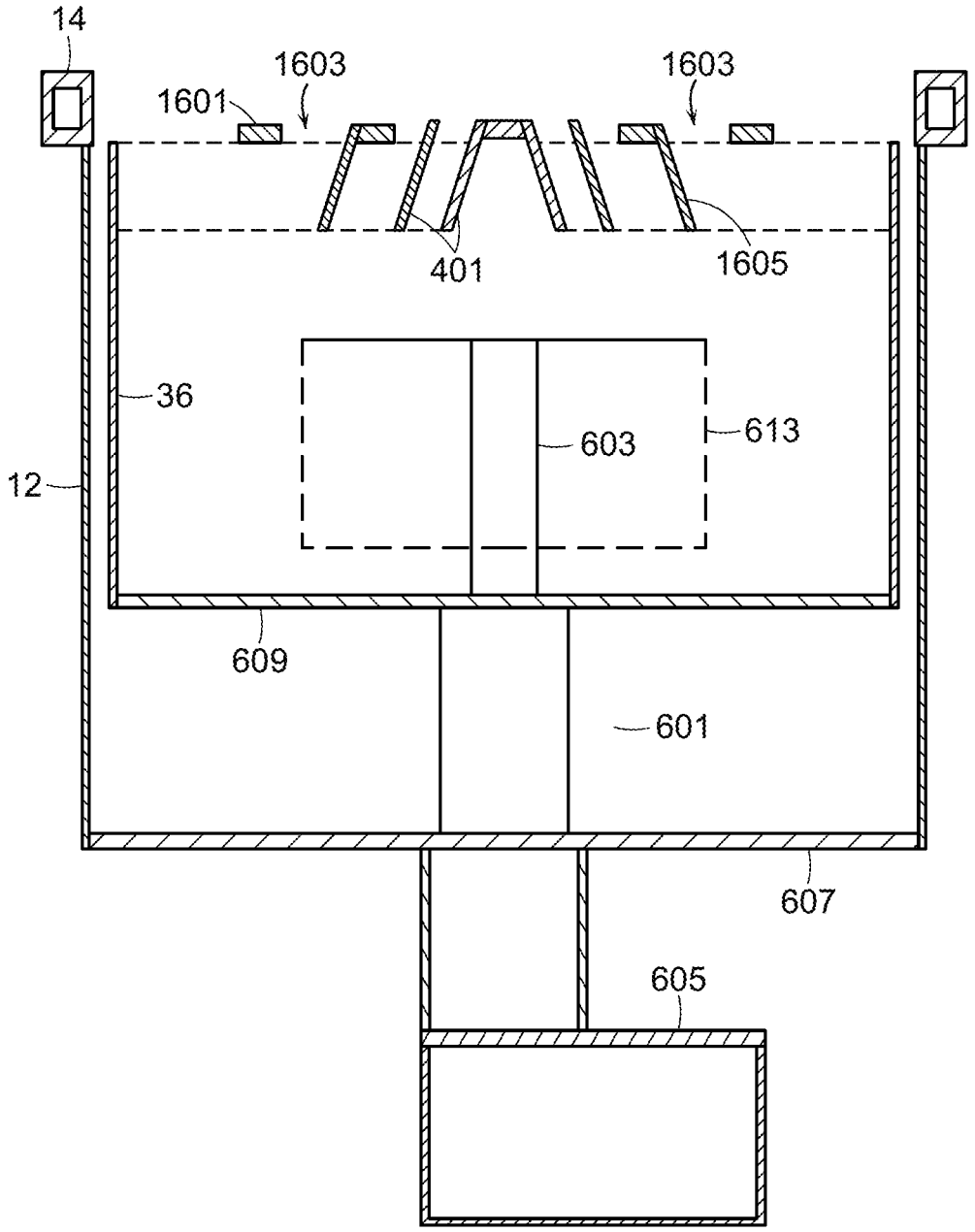
FIG. 17 is a cross-sectional view of a cryopump embodying the orifice plate of FIG. 16.

A cross-section of the cryopump of FIG. 16 is shown in FIG. 17.

Figure 18:
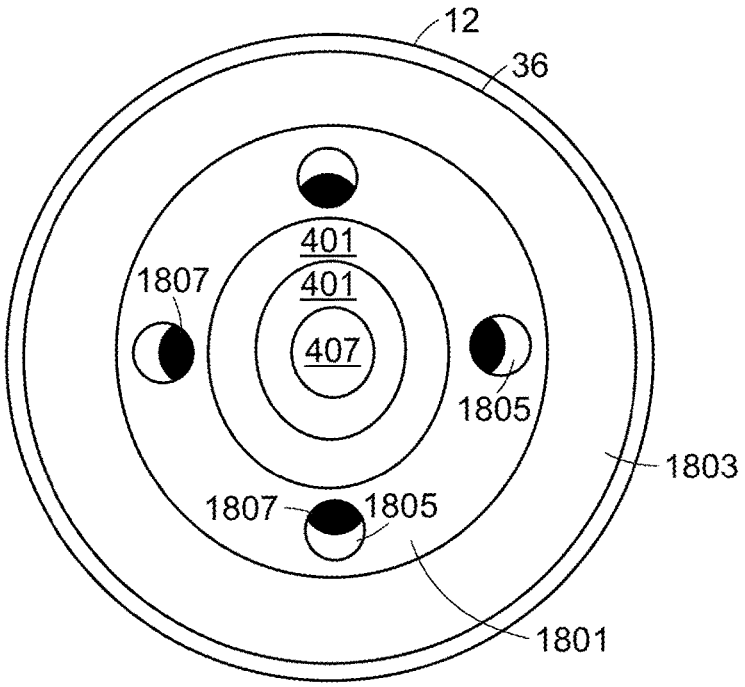
FIG. 18 is an embodiment of the hybrid array in which flaps in circular orifices are formed in the plugs.
Figure 19:
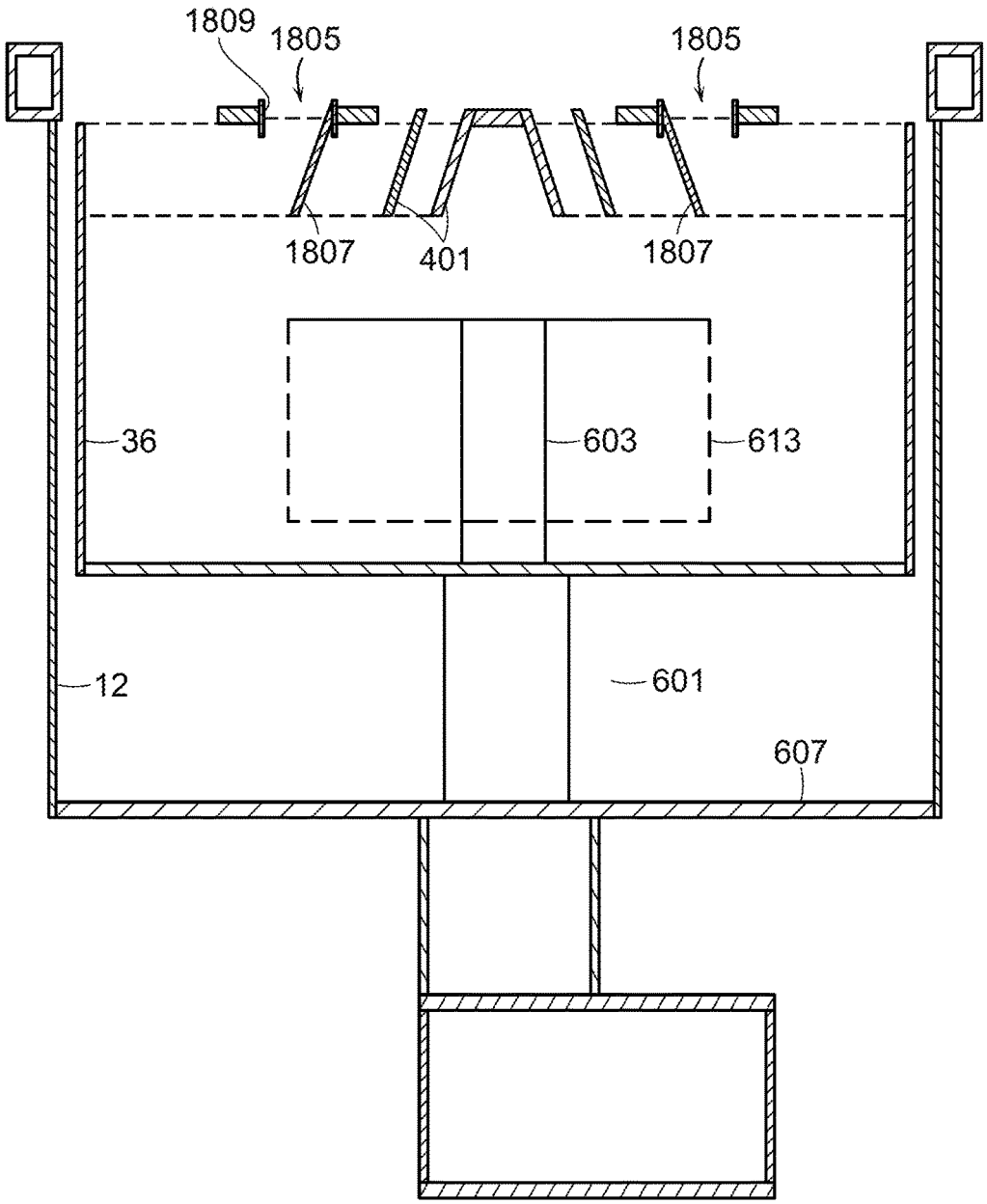
FIG. 19 is a cross-sectional view of a cryopump having a baffled orifice plate in which the baffles are formed in plugs.

FIG. 18 illustrates an embodiment similar to FIG. 16 except that it provides greater on site adjustability through the use of plugs to form the baffles. The orifice plate 1801 is surrounded by an open space 1803. Orifices 1805 are open circular holes that may be closed by plugs or, as shown, plugged with partially open plugs having flaps 1807 to provide baffles that direct radiation outwardly to the radiation shield. The cryopump of FIG. 18 is shown in cross-section in FIG. 19. As can be seen, the plugs 1809 fit in the open orifices and have flaps 1807 that are attached through the plugs to the orifice plate.

Figure 20:
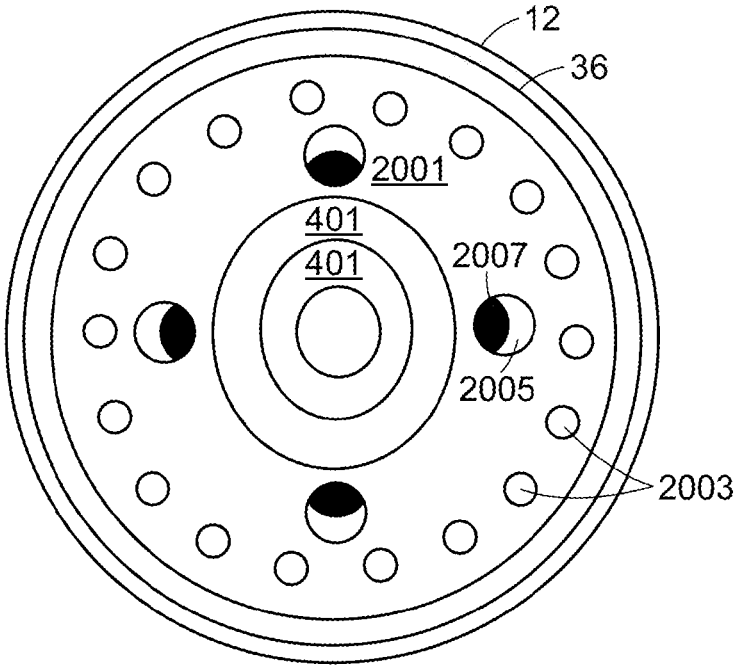
FIG. 20 is an embodiment of the hybrid array having an orifice plate with both baffled orifices and open orifices.

FIG. 20 illustrates an embodiment having a single orifice plate 2001 surrounding the louvers 401 close to the full diameter of the radiation shield. This orifice plate, however, includes an outer circular array of orifices 2003 that may be selectively plugged. An inner array of larger orifices 2005 is also provided. The orifices 2005 include flaps 2007 serving as baffles. Orifices 2003 may be larger or smaller in dimension than the inner orifices 2005 and/or the orifices may have varying dimensions. Alternatively, all orifices may be of the same size.

Figure 21:
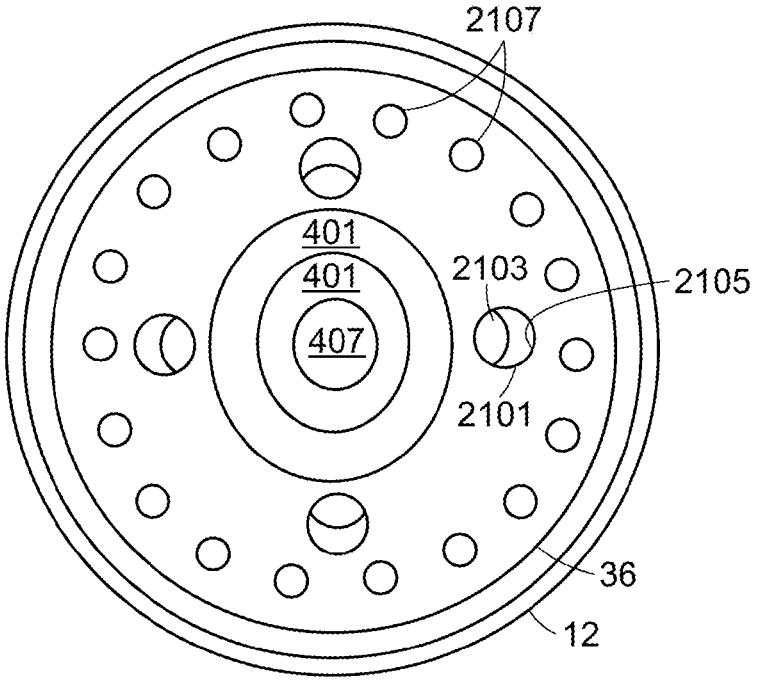
FIG. 21 is an embodiment of the hybrid array similar to FIG. 19 but in which the baffles are formed in plugs.

The embodiment of FIG. 21 is similar to that of FIG. 20 except that the inner array of orifices is of open circular holes. Baffles are provided by flaps 2103 formed in plugs 2105. As an alternative to the baffled plugs, holes may be selectively closed by full closure plugs. As before, an outer array of the smaller orifices 2107 is also provided. Those orifices may also be selectively closed or baffled.

Figure 22:
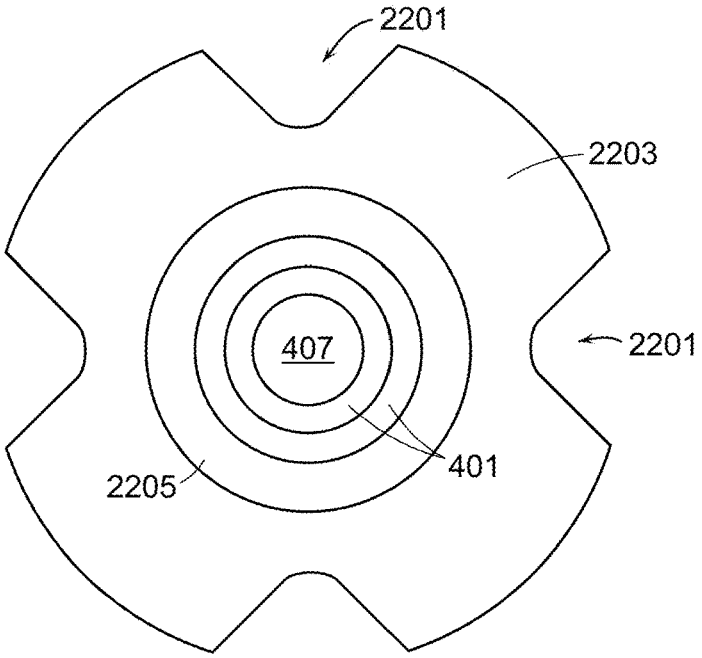
FIG. 22 illustrates an embodiment of the hybrid array wherein the orifices are formed as cutouts in an edge of a plate.

FIG. 22 illustrates an embodiment in which the orifices are defined by cutouts 2201 of an edge of the plate 2203. In this embodiment the cutouts are in the outer edge, but they could alternatively or additionally be included on the inner edge of the plate 2203. As before, the plate 2203 surrounds a center disk 407 and louvers 401. An open space 2205 may or may not be provided between the louvers and the plate 2203.

Figure 23:
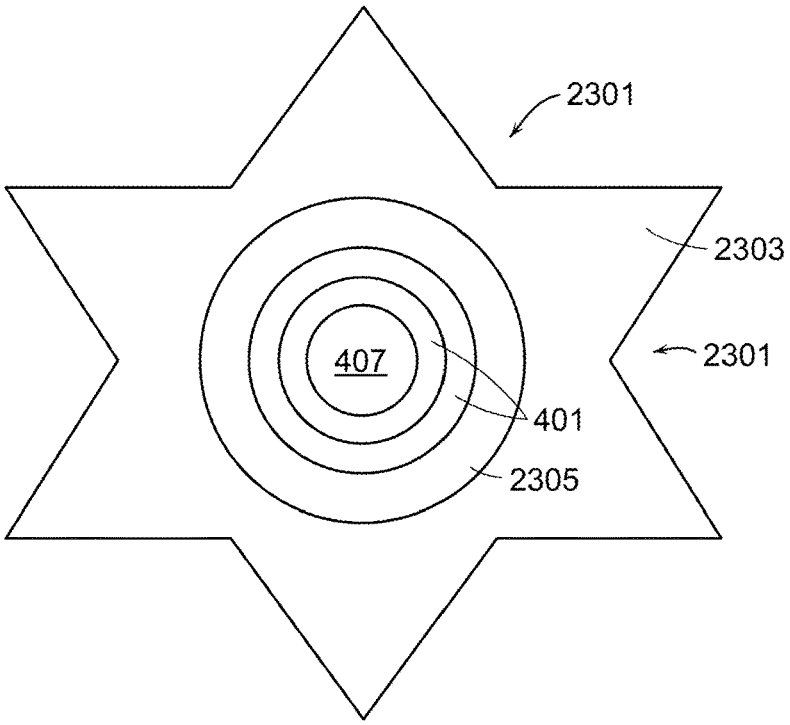
FIG. 23 illustrates an embodiment of the hybrid array in which flow paths past the plate are provided by an undulating edge of the plate.

In FIG. 23, orifices 2301 are again defined along an outer edge of the plate 2303. In this case, they are formed by an undulating edge. The undulation is shown in the outer edge but might also be provided in the inner edge of the plate. Again, the plate surrounds the center disk 407 and louvers 408. An open space 2305 may or may not be provided between the louvers and the plate.

The orifices could also be defined by a polygon plate within a circular radiation shield. In each embodiment having edge-defined orifices, orifices may also be formed within the plates.

Figure 24:
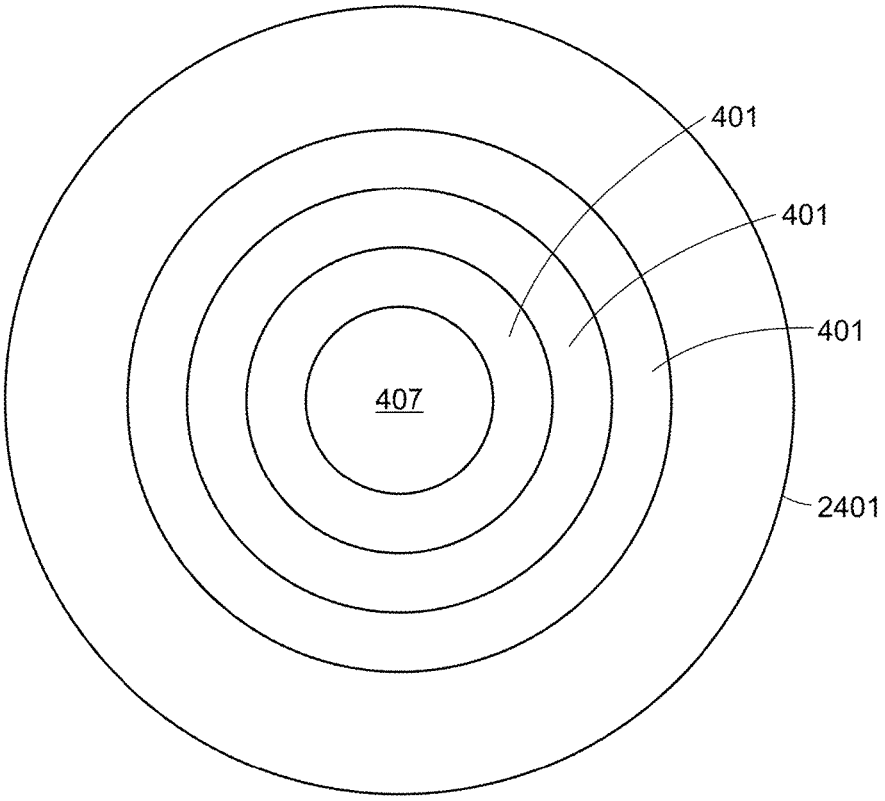
FIG. 24 is an embodiment of the hybrid array in which a solid plate surrounds the louvers.

FIG. 24 illustrates an embodiment in which a solid plate 2401 surrounds the center disk 407 and louvers 401. The solid disk functions in the same manner as an orifice plate having all of the orifices plugged. The solid plate 2401 is appropriate where reduction in heat load on the second stage array and increased process pressure are preferred over pump speed. However, the plate can be readily replaced by an orifice plate if additional pump speed is preferred.

The teachings of all patents, published applications and references cited herein are incorporated by reference in their entirety.

While this invention has been particularly shown and described with references to example embodiments thereof, it will be understood by those skilled in the art that various changes in form and details made be made therein without departing from the scope of the invention encompassed by the appended claims.

What is claimed is:

1. A cryopump for evacuating a chamber comprising:

a refrigerator;

a condensing array cooled by the refrigerator;

a radiation shield surrounding the condensing array and cooled by the refrigerator, the radiation shield having a frontal opening; and a frontal array across the frontal opening of the radiation shield, the frontal array cooled by the refrigerator and comprising:

concentric louvers of increasing diameter across a center region of the frontal opening; and an orifice plate having orifices therein, through which gas flows form the chamber, across an outer region of the frontal opening, the orifice plate surrounding the concentric louvers at a central opening in the plate.

2. The cryopump as claimed in claim 1 wherein each of plural orifices of the orifice plate has a flap attached to the orifice plate that directs gas flowing through the orifice.

3. The cryopump as claimed in claim 2 wherein the flaps are attached through partially open plugs inserted into the orifices.

4. The cryopump as claimed in claim 1 wherein at least one orifice of the orifice plate is closed by a removable plug.

5. The cryopump as claimed in claim 1 wherein the louvers and orifice plate extend across at least 90% of the frontal opening.

6. The cryopump as claimed in claim 1 wherein a substantial an open space in the frontal opening surrounds the orifice plate radially beyond a peripheral edge of the orifice plate.

7. The cryopump as claimed in claim 1 wherein an open space is provided between the louvers and the orifice plate.

8. The cryopump as claimed in claim 1 comprising plural orifice plates surrounding the louvers.

9. The cryopump as claimed in claim 8 wherein a space is provided between the plural orifice plates.

10. The cryopump as claimed in claim 1 wherein the louvers are circular and the orifice plate surrounds the louvers and has a circular array of orifices therein through which gas flows.

11. The cryopump as claimed in claim 1 further comprising plural arrays of orifices of different sized orifices through which gas flows.

12. The cryopump as claimed in claim 1 comprising an inner array of orifices through which gas flows, which comprise flaps that are attached to the orifice plate at an edge of each orifice, and an outer array of open orifices through which gas flows without flaps.

13. The cryopump of claim 1 wherein the louvers include a chevron pointing radially outward.

* * * * *